US006782361B1

(12) United States Patent
El-Maleh et al.

(10) Patent No.: US 6,782,361 B1
(45) Date of Patent: Aug. 24, 2004

(54) METHOD AND APPARATUS FOR PROVIDING BACKGROUND ACOUSTIC NOISE DURING A DISCONTINUED/ REDUCED RATE TRANSMISSION MODE OF A VOICE TRANSMISSION SYSTEM

(75) Inventors: Khaled Helmi El-Maleh, Montreal (CA); Peter Kabal, Montreal West (CA)

(73) Assignee: McGill University, Montreal (CA)

( * ) Notice: Subject to any disclaimer, the term of this patent is extended or adjusted under 35 U.S.C. 154(b) by 0 days.

(21) Appl. No.: 09/518,242

(22) Filed: Mar. 3, 2000

Related U.S. Application Data

(60) Provisional application No. 60/139,751, filed on Jun. 18, 1999.

(51) Int. Cl.[7] ..... G10L 19/14

(52) U.S. Cl. ..... 704/226; 704/233; 704/223

(58) Field of Search ..... 704/226–228, 704/200, 202, 219–223, 210, 215, 258, 262, 264

(56) References Cited

U.S. PATENT DOCUMENTS

| | | | | | |
|---|---|---|---|---|---|
| 5,327,519 | A | | 7/1994 | Haggvist et al. | 395/2.28 |
| 5,642,464 | A | * | 6/1997 | Yue et al. | 704/215 |
| 5,794,199 | A | * | 8/1998 | Rao et al. | 704/258 |
| 5,907,822 | A | * | 5/1999 | Prieto, Jr. | 704/202 |
| 5,978,760 | A | * | 11/1999 | Rao et al. | 704/226 |
| 6,101,466 | A | * | 8/2000 | Rao et al. | 704/233 |

FOREIGN PATENT DOCUMENTS

| | | | |
|---|---|---|---|
| EP | 843301 | 5/1998 | G10L/3/02 |

OTHER PUBLICATIONS

*Frame–level Noise Classification in Mobile Environments* by Khaled El–Maleh, Ara Samouelian and Peter Kabal, 1999 I.E.E.E. International Conference on Acoustics, Speech and Signal Processing, vol. I, pp. 237–240.

*Natural–Quality Background Noise Coding Using Residual Substitution*, by Khaled El–Maleh, Peter Kabal, Dept. Electrical & Computer Engineering McGill University, Montreal, Quebec, Canada H3A 2A7, 1999, Eurospeech 99, pp. 1–4.

* cited by examiner

*Primary Examiner*—David D. Knepper
(74) *Attorney, Agent, or Firm*—Thomas Adams

(57) ABSTRACT

Natural-quality synthetic noise will replace background acoustic noise during speech gaps and will achieve a better representation of the excitation signal in a noise-synthesis model by classifying the type of acoustic environment noise into one or more of a plurality of noise classes. The noise class information is used to synthesize background noise that sounds similar to the actual background noise during speech transmission. In some embodiments, the noise class information is derived by the transmitter and transmitted to the receiver which selects corresponding excitation vectors and filters them using a synthesis filter to construct the synthetic noise. In other embodiments, the receiver itself classifies the background noise present in hangover frames and uses the class information as before to generate the synthetic noise. The improvement in the quality of synthesized noise during speech gaps helps to preserve noise continuity between talk spurts and speech pauses, and enhances the perceived quality of a conversation.

35 Claims, 9 Drawing Sheets

METHOD AND APPARATUS FOR PROVIDING BACKGROUND ACOUSTIC NOISE DURING A DISCONTINUED/ REDUCED RATE TRANSMISSION MODE OF A VOICE TRANSMISSION SYSTEM

This application claims the benefit of Provisional application Ser. No. 60/139,751, filed Jun. 18, 1999.

TECHNICAL FIELD

This invention relates to a method and apparatus for providing background acoustic noise during a discontinued/reduced rate transmission mode of a voice transmission system. The invention is especially applicable to digital voice communications and more particularly to wireless voice communications systems, and bit-rate sensitive applications including digital simultaneous voice and data (DSVD) systems, voice over internet-protocol (VOIP) and digital speech interpolation (DSI) systems.

BACKGROUND ART

In wireless voice communication systems, it is desirable to reduce the level of transmitted power so as to reduce co-channel interference and to prolong battery life of portable units. In cellular systems, interference reduction enhances spectral efficiency and increases system capacity. One way to reduce the power level of transmitted information is to reduce the overall transmission bit rate. A typical telephone conversation comprises approximately 40 per cent active speech and about 60 per cent silence and non-speech sounds, including acoustic background noise. Consequently, it is known to discontinue transmission during periods when there is no speech.

Other wireless systems require a continuous mode of transmission for system synchronization and channel monitoring. It is inefficient to use the full speech-coding rate mode for the background acoustic noise because it contains less information than the speech. When speech is absent, a lower rate coding mode is used to encode the background noise. In Code Division Multiple Access (CDMA) wireless communication systems, variable bit rate (VBR) coding is used to reduce the average bit rate and to increase system capacity. The very low bit rate used during speech gaps is insufficient to avoid perceptible discontinuities between the background noise accompanying speech and during speech gaps.

A disadvantage of simply discontinuing transmission, as done by early systems, is that the background noise stops along with the speech, and the resulting received signal sounds unnatural to the recipient.

This problem of discontinuities has been addressed by generating synthetic noise, known as "comfort noise", at the receiver and substituting it for the received signal during the quiet periods. One such silence compression scheme using a combination of voice activity detection, discontinuous transmission, and synthetic noise insertion has been used by Global System for Mobile Communications (GSM) wireless voice communication systems. The GSM scheme employs a transmitter, which includes a voice activity detector (VAD) which discriminates between voice and non-voice signals, and receiver which includes a synthetic noise generator. When the user is speaking, the transmitter uses the full coding rate to encode the signal. During quiet periods, i.e. when no speech is detected, the transmitter is idle except for periodically updating background noise information characterizing the "real" background noise. When the receiver detects such quiet periods, it causes the synthetic noise generator to generate synthetic noise, i.e. comfort noise, and insert it into the received signal. During the quiet periods, the transmitter transmits to the receiver updated information about the background noise using what are known as Silence Insertion Descriptor (SID) frames and the receiver uses the parameters to update its synthetic noise generator.

It is known to generate the synthetic noise by passing a spectrally-flat noise signal (white noise) through a synthesis filter in the receiver, the noise parameters transmitted in the SID frames then being coefficients for the synthesis filter. It has been found, however, that the human auditory system is capable of detecting relatively subtle differences, and a typical recipient can perceive, and be distracted by, differences between the real background noise and the synthetic noise. This problem was discussed in European patent application number EP 843,301 by K. Jarvinen et al., who recognized that a user can still perceive differences where the spectral content of the real background noise differs from that of the synthetic noise. In order to reduce the spectral quality differences, Jarvinen et al. disclosed passing the random noise excitation signal through a spectral control filter before applying it to the synthesis filter. While such spectral modification of the excitation signal might yield some improvement over conventional systems, it is not entirely satisfactory. Mobile telephones, in particular, may be used in a wide variety of locations and the typical user can still perceive the concomitant differences between the background noise accompanying speech and the synthetic noise inserted during non-speech intervals.

DISCLOSURE OF INVENTION

An object of the present invention is to provide a background noise coding method and apparatus capable of providing synthetic noise ("comfort" noise) which sounds more like the actual background noise.

To this end, in communications systems embodying the present invention, the background noise is classified into one or more of a plurality of noise classes and the receiver selects one or more of a corresponding plurality of different excitation signals for use in generating the synthetic noise.

According to one aspect of the present invention, in a digital communications system comprising a transmitter and a receiver, the transmitter interrupting or reducing transmission of a voice signal during interval absent speech and the receiver inserting synthetic noise into the received voice signals during said intervals, there is provided a method comprising the steps of assigning acoustic background noise in the voice signal to one or more of a plurality of noise classes, selecting a corresponding one of a plurality of excitation vectors each corresponding to at least one of the classes, using at least part of the selected noise vector to synthesize the synthetic noise, and outputting the synthetic noise during a said interval.

According to a second aspect of the present invention, there is provided a digital communications system comprising a transmitter and a receiver, the transmitter having means for interrupting or reducing transmission of a voice signal during interval absent speech and the receiver having means for inserting synthetic noise into the received voice signals during said intervals, there being provided means for assigning acoustic background noise in the voice signal to one or more of a plurality of noise classes, selecting a corresponding one of a plurality of excitation vectors each corresponding to at least one of the classes, using at least part of the selected excitation vector to synthesize the synthetic noise, and outputting the synthetic noise during a said interval.

In embodiments of either aspect, the transmitter may perform the classification of the background noise and transmit to the receiver a corresponding noise index and the receiver may select the corresponding excitation vector(s) in dependence upon the noise index. The receiver may select from a plurality of previously-stored vectors, or use a generator to generate an excitation vector with the appropriate parameters.

The predefined noise classes may be defined by temporal and spectral features based upon a priori knowledge of expected input signals. Such features may include zero crossing rate, root-mean-square energy, critical band energies, and correlation coefficients. Preferably, however, noise classification uses line spectral frequencies (LSFs) of the signal, with a Gaussian fit to each LSF histogram.

Preferably, the noise classification is done on a frame-by-frame basis using relatively short segments of the input voice signal, conveniently about 20 milliseconds.

In preferred embodiments of either aspect of the invention, linear prediction (LP) analysis of the input signal is performed every 20 milliseconds using an autocorrelation method and windows each of length 240 samples overlapping by 80 samples. The LP coefficients then are calculated using the Levinson-Durbin algorithm and bandwidth-expanded using a factor $\gamma=0.994$. The LP coefficients then are converted into the LSF domain using known techniques.

The classification unit may determine that the background noise comprises noise from a plurality of the noise classes and determine proportions for mixing a plurality of said excitation vectors for use in generating the synthetic noise. The relative proportions may be transmitted as coefficients and the receiver may multiply the coefficients by the respective vectors to form a mixture.

The transmitter may transmit one or more hangover frames at the transition between speech and no speech, such hangover frames including background noise, and the receiver then may comprise means for deriving the noise class index from the noise in that portion of the received signal corresponding to the hangover frames. The extracting means may comprise a noise classifier operative upon residual noise energy and synthesis filter coefficients to derive the noise class indices.

BEST MODE(S) FOR CARRYING OUT THE INVENTION

Figure 1:
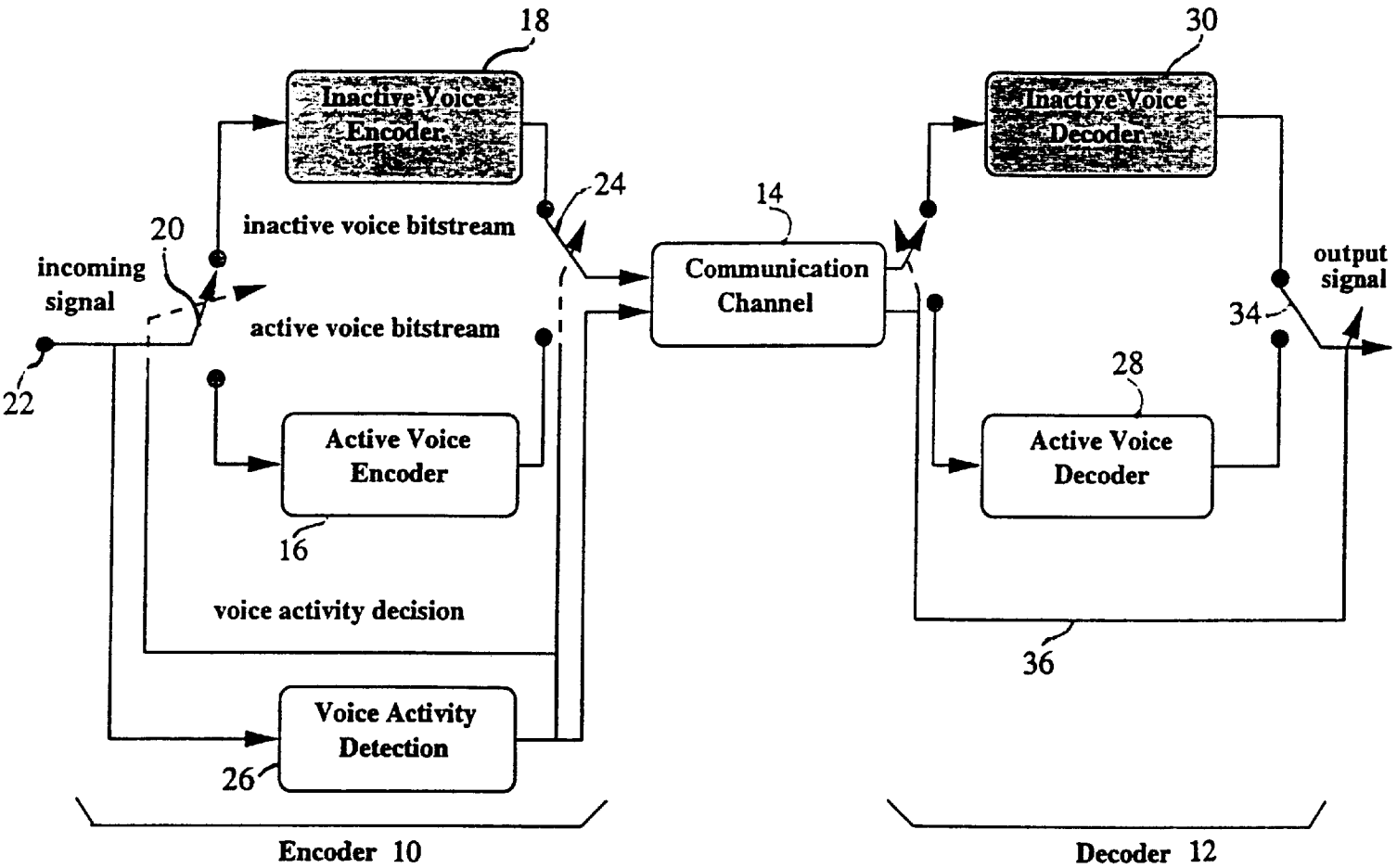
FIG. 1 illustrates, schematically, a speech communication system in which a codec includes a voice activity detector which selects, alternatively, active and inactive voice encoders depending upon whether or not speech is detected.

In the drawings, identical or corresponding items in the different Figures have the same reference numeral, a prime being used to denote modification.

Referring to FIG. 1, which illustrates a part of a digital communications system, a transmitter section comprises an encoding unit 10 coupled to a decoding unit 12 in a receiver section by way of a communications channel 14 which, in the case of a wireless system, might be free space. The encoding unit 10 comprises an active voice encoder 16 and an inactive voice encoder 18 connected to respective outputs of a selector 20, shown as a switch, having its input connected to an input port 22 whereby the encoding unit 10 receives the incoming signal for encoding and transmission. The respective outputs of the active voice encoder 16 and inactive voice encoder 18 are connected to inputs terminals of a second selector 24, also shown as a switch, having its output connected to the communications channel 14. The selectors 22 and 24 are "ganged" for simultaneous operation under the control of a voice activity detector (VAD) 26 which has an input connected directly to encoding unit input port 22 and an output connected directly to the communications channel 14.

The decoding unit 12 has an active voice decoder 28 and an inactive voice decoder 30 with their inputs connected to respective outputs of a selector 32, which has its input connected to the communications channel 14. The outputs of the active voice decoder 28 and the inactive voice decoder 30 are connected to respective inputs/poles of a selector 34, the output of which is the output of the decoding unit 12. The selectors 32 and 34 are "ganged" for operation simultaneously by control signals from the VAD 26 communicated over the channel and link 36.

In operation, when the VAD 26 detects that the incoming signal comprises speech, it operates the selectors 20 and 24 to connect the active voice encoder 16 in circuit and signals to the decoding unit 12 to cause the latter to connect the active voice decoder 28 in circuit. Conversely, when the VAD 26 detects no speech, it connects the inactive voice encoder 18 in circuit and instructs the selectors 32 and 34 to connect the inactive voice decoder in circuit.

The encoders 16 and 18 are linear prediction encoders and the decoders 28 and complementary linear prediction decoders. The active voice encoder 16 and active voice decoder 28 are conventional and will not be described in detail.

Figure 2:
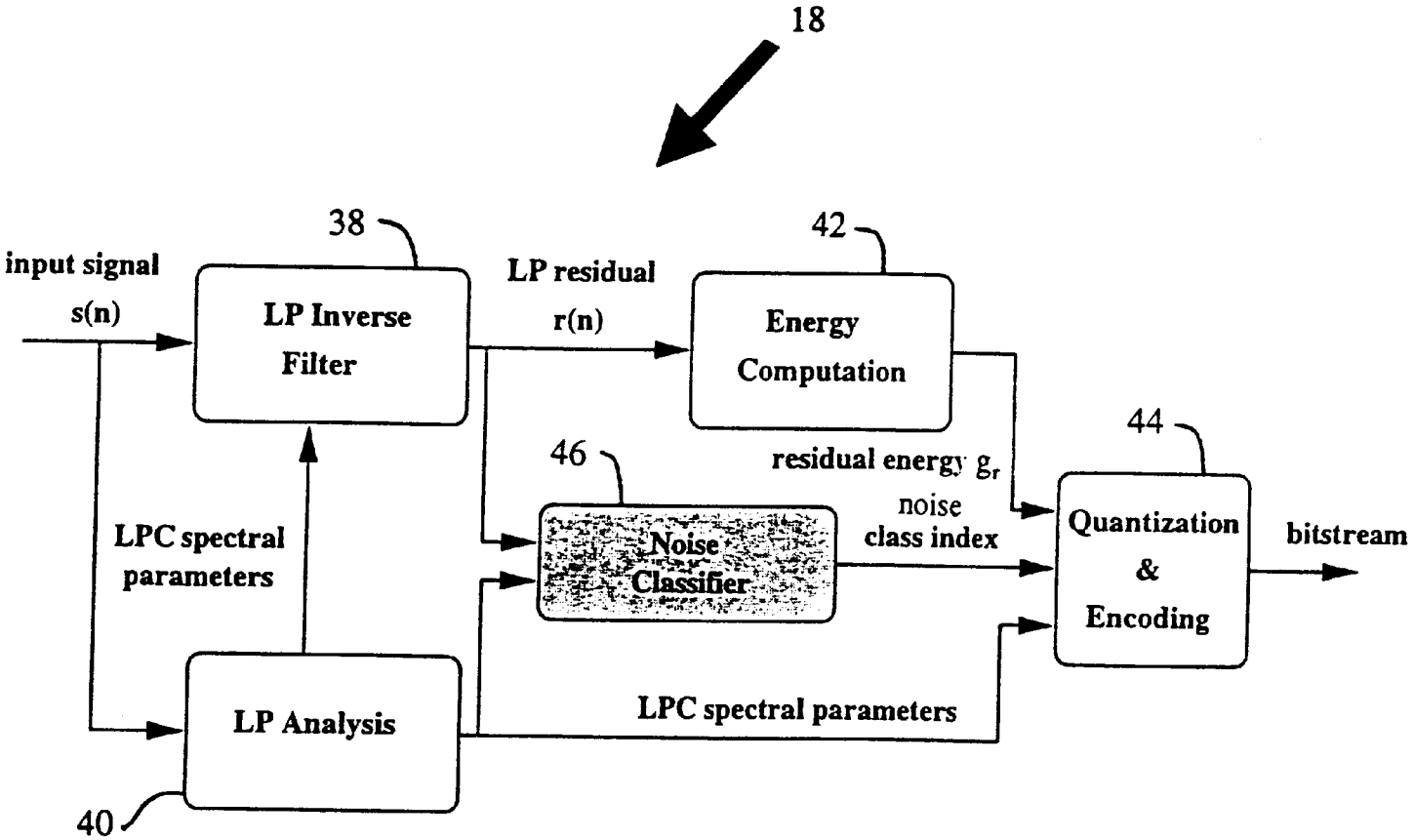
FIG. 2 illustrates an encoder of a linear prediction-based noise codec according to one embodiment of the present invention.

An inactive voice encoder 18 according to a first embodiment of the invention is illustrated in FIG. 2. The input signal s(n) is processed on a frame-by-frame basis (i.e. each frame is a short segment of length 10–40 ms). Each frame of the input signal s(n) is supplied to both an LP Inverse filter 38 and an LP Analysis module 40. The LP analysis module 40 analyses the input signal frame to estimate a set of linear prediction coefficient (LPC) spectral parameters of order p, where p typically is between 5 and 12. The LP analysis module 40 supplies the parameters to LP inverse filter 38 which filters the input signal s(n) to produce the LP residual signal r(n). The LP residual signal r(n) is not encoded but rather is applied to an energy computation module 42 which computes its energy and supplies a corresponding value to a quantization and encoding module 44. The coding of the energy for transmission to the quantization and encoding module may be done by any suitable means, such as those used in existing GSM and CDMA systems. The LP analysis module 40 also supplies to the quantization and encoding module 44 the LPC spectral parameters used by the LP inverse filter 38 when filtering the frame.

The residual signal r(n) and the LPC spectral parameters are also supplied to a noise classifier 46 which uses them to determine the type of background noise and, using criteria to be described later, produce a noise class index which it supplies to the quantization and encoding unit 44. The quantization and encoding unit 44 quantizes and encodes the LPC spectral parameters, the residual energy $g_r$ and the noise class index into a bit stream for transmission via the communications channel 14.

Figure 3:
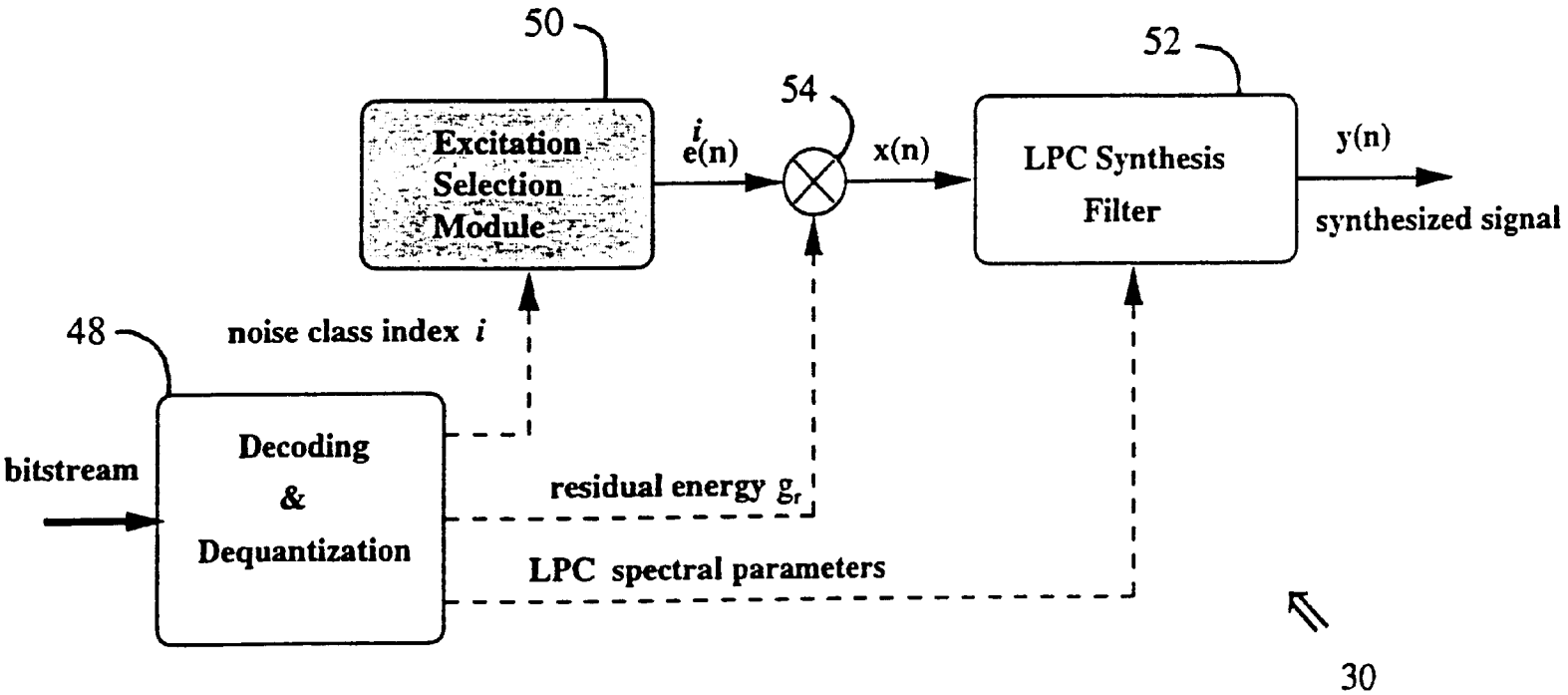
FIG. 3 illustrates a decoder of the linear prediction-based noise codec.

Referring now to FIG. 3, the pertinent parts of the inactive voice decoder 30 comprise a decoding and dequantization unit 48, an excitation selection module 50, and LPC synthesis filter 52 and a multiplier 54. The decoding and dequantization unit 48 decodes and dequantizes the incoming bitstream from the channel 14 to extract the LPC spectral parameters, which it supplies to the LPC synthesis filter 52, the value of the residual energy $g_r$, which it supplies to the multiplier 54, and the noise class index, which it supplies to the excitation selection module 50. In response to the noise class index, the excitation selection module 50 selects the appropriate excitation vector $e^i(n)$ and applies it to the multiplier 54 which scales the excitation vector $e^i(n)$ with the residual energy $g_r$ to give the LPC excitation signal x(n). The LPC synthesis filter 52, with its coefficients updated with the LPC spectral parameters from decoding and dequantizing module 48, is excited by the LPC excitation signal x(n) to output a synthetic noise signal y(n).

In embodiments of the present invention, information about the type of background noise is used to substitute, at the receive side, an appropriate stored or generated LP residual that preserves the perceptual texture of the input background noise.

Figure 4:
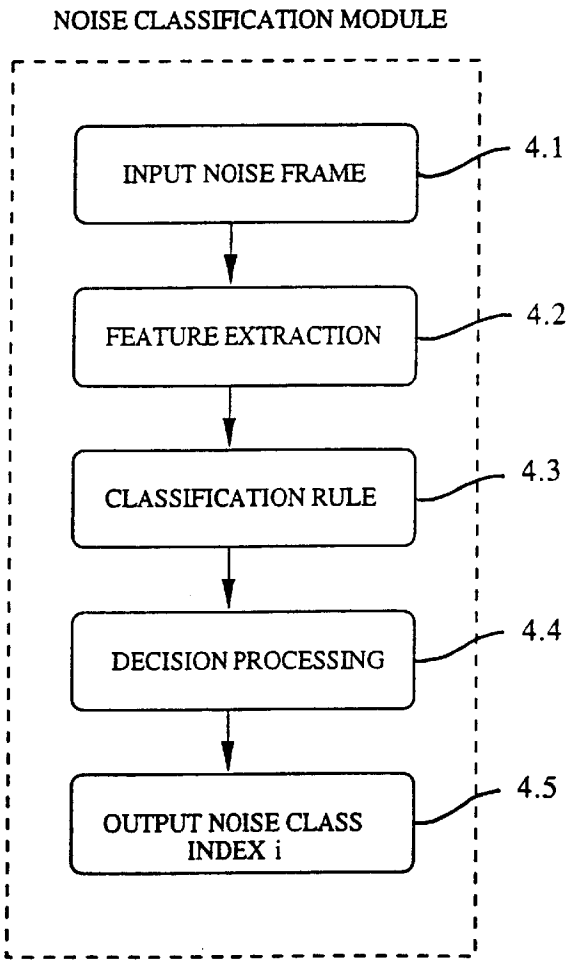
FIG. 4 illustrates functions of a noise classifier of the encoder of FIG. 2.

FIG. 4 depicts the internal processing of the noise classifier 46. Before use, however, the classifier 46 must be programmed with suitable classification rules and decision rules. The first step in designing an M-class noise classifier 46 is to define the M noise classes of interest. The noise classes usually will be different types of background noise, for example car noise, "babble" (a large number of simultaneous talkers), and other noise types common in wireless environments. A set of signal features then is specified that, in combination with a selected classification algorithm, give good classification results. A common way to represent such a classifier is in terms of a set of discriminant functions $g_i(x)$, i=1, 2, . . . , M. The classifier assigns a feature vector x to class $C_i$ if $g_i(x)>g_j(x)$, for every $j\neq i$.

The effect of any decision rule is to divide the feature space into M disjoint decision regions $R_1, R_2, \ldots, R_M$ separated by decision surfaces. Generally, if the features are chosen well, vectors belonging to the same class will group together in clusters in the feature space. During the training phase, the training data for each noise class, in the form of labelled feature vectors, is used to design the decision rule. Conveniently, the training data is obtained from a large number of recordings of each type of background noise made in the appropriate environment.

In operation, the noise classifier 46 will determine the class to which the feature vector extracted from the actual background noise most likely belongs. The classification of an input vector x reduces to its assignment to a class based upon its location in feature space.

Referring now to FIGS. 2 and 4, in step 4.1, a set of noise features from the LP residual signal r(n) and the LPC spectral parameters are input to the noise classifier. As illustrated in FIG. 4, the feature extraction step 4.2 extracts from the input noise frame the set of predetermined features and applies them to a classification rule module, which in step 4.3 maps the input feature vector to the classes to determine the optimum background noise class, i.e. that closest to the actual background noise type, and supplies the decision to a decision processing module.

Classification at the transmitter can use any set of features from the input signal that discriminates between noise classes. It has been found, however, that Line Spectral Frequencies (LSFs) give better quantization properties than the LPC spectral parameters. Such LSFs are derived from the LPC spectral parameters and are commonly used in linear predictive speech coders to parameterize the spectral envelope. Accordingly, it is preferable to perform noise classification in the noise classifier 46 using the unquantized LSFs. Hence, the feature extraction module supplies LSFs as the required features to the classification algorithm. Experiments have shown that the LSFs are robust features in distinguishing different classes of background environment noises. Nevertheless, it would be possible to use other features, such as zero crossing rate, root-mean-square energy, critical band energies, correlation coefficients, and so on. For more information about the classification of background noise, the reader is directed to the article "Frame-level Noise Classification in Mobile Environments" by Khaled El-Maleh et al., 1999 I.E.E.E. International Conference on Acoustics, Speech and Signal Processing, vol. I, pp. 237–240, which is incorporated herein by reference.

To improve the classification accuracy further, in step 4.4 the decision processing module detects spurious or obviously incorrect classifications by the classification rule, for example one frame different from preceding and succeeding frames. In step 4.5, the decision is output as the noise class index i which is transmitted to the receiver for class-dependent excitation selection.

Figure 5:
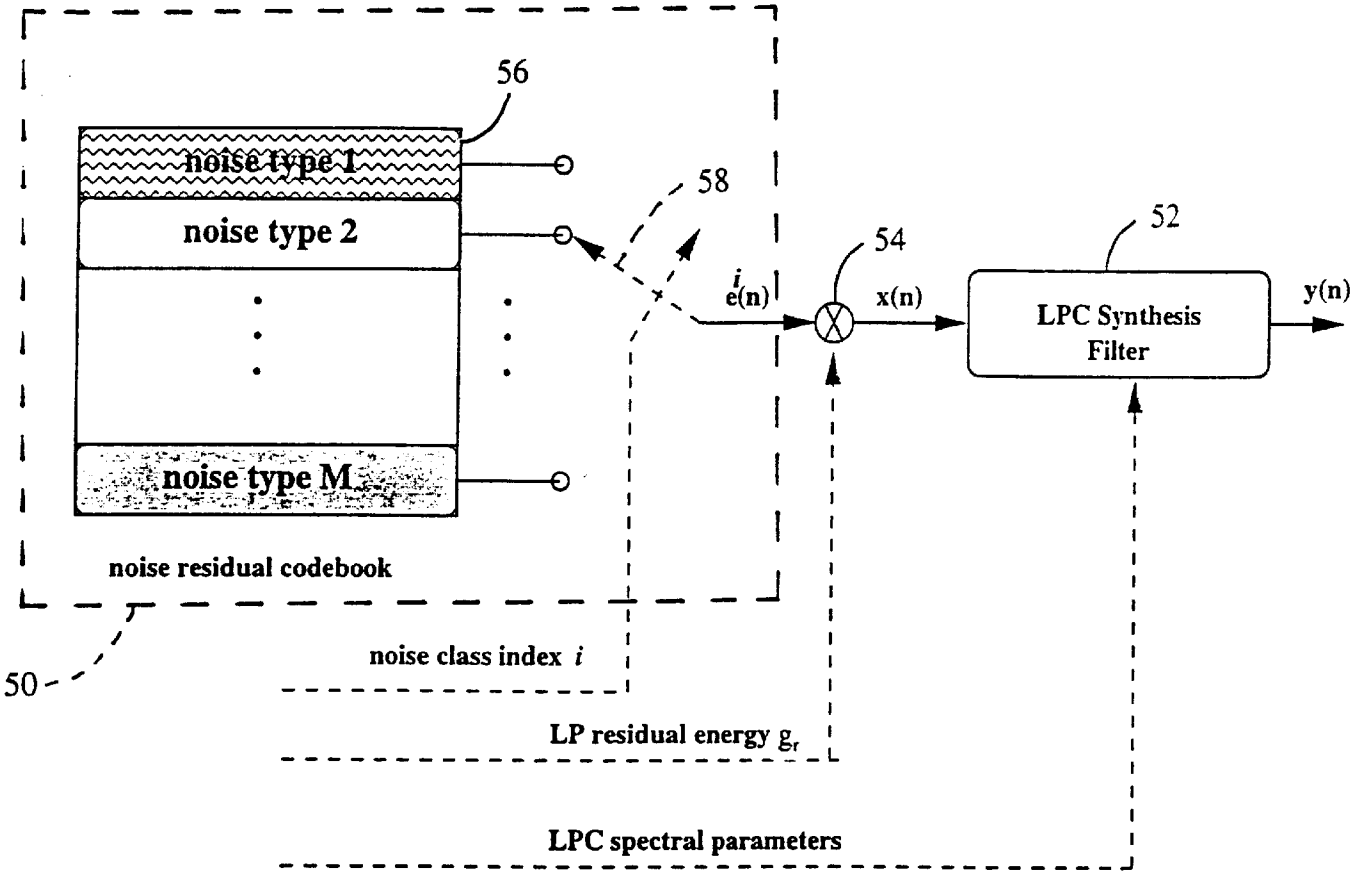
FIG. 5 illustrates an excitation module of the decoder of FIG. 3.

FIG. 5 illustrates the complementary class-dependent decoder 30 without the decoding and dequantization unit 48 but with the corresponding excitation selection module 50 shown in more detail. The excitation selection module 50 comprises a codebook 56 storing a plurality of LP excitation vectors from M noise types, each comprising an LP residual waveform, with normalized energy, of a typical segment of each noise class. Each vector is previously selected, stored and labelled by the corresponding noise class index i. The excitation codebook has a size of M×L, where M is the number of noise types, i.e. each representing one of the different background noise types from which the noise classifier 46 in encoder 18 made its selection, and L is the length (in frames) of the stored LP excitation for each noise type. The length of each stored excitation vector should be long enough to avoid any perceived repetition of noise. For example, each excitation vector may comprise 50 to 1000 frames, each frame typically of 20 milliseconds duration (160 samples). Sequential selection of the appropriate vector frames is made by a selector 58 controlled by the noise class index i. Each excitation vector frame $e^i(n)$, when applied to the synthesis filter 52, will produce a synthetic noise which is perceptually similar to the corresponding noise type selected by the noise classifier 46 in the encoder 18.

Figure 6:
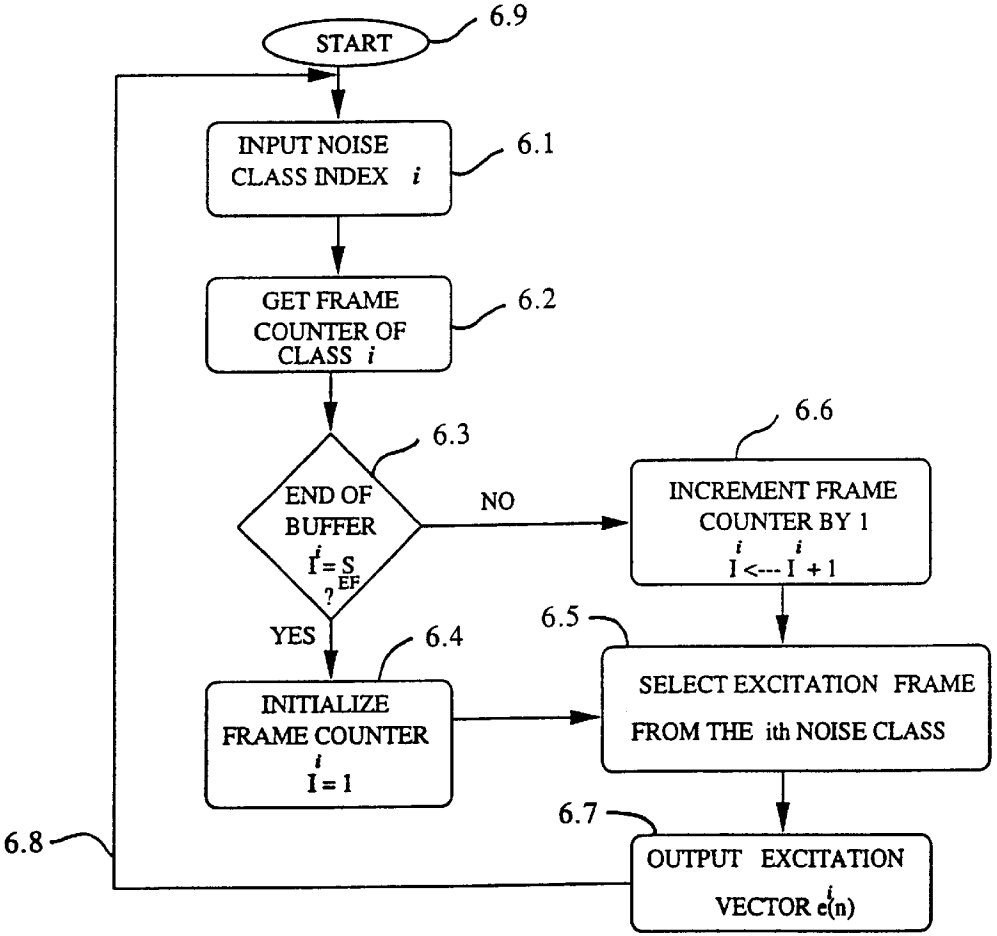
FIG. 6 is a flow chart illustrating the internal operation of the excitation selection module of FIG. 5.

FIG. 6 is a flow chart illustrating the internal operation of the excitation selection module 50, which has M excitation frame counters. To preserve the perceptual texture of the reconstructed noise, and to avoid interruptions, the excitation signal is constructed from sequential excitation samples. In step 6.1, the noise class index is input from the decoding and dequantization unit 48. In steps 6.2 to 6.6, the frame counter of the $i^{th}$ noise class is used in the process of copying a segment of the $i^{th}$ excitation codevector. Logical tests are done in steps 6.3 and 6.4 to allow for the re-use of the excitation codevectors. Thus, step 6.3 determines if the frame counter value is equal to the length of the excitation codevector (i.e. end of the codevector), whereupon step 6.4 initializes the frame counter to point to the start of the codevector. In step 6.6, the frame counter is incremented by one whenever it is used to output an excitation vector. Step 6.5 selects the excitation signal for the $i^{th}$ noise class and, in step 6.7, the selector 58 outputs the selected excitation signal $e^i(n)$ to the LPC synthesis filter 52 and the loop 6.8 returns to the start 6.9.

Figure 7:
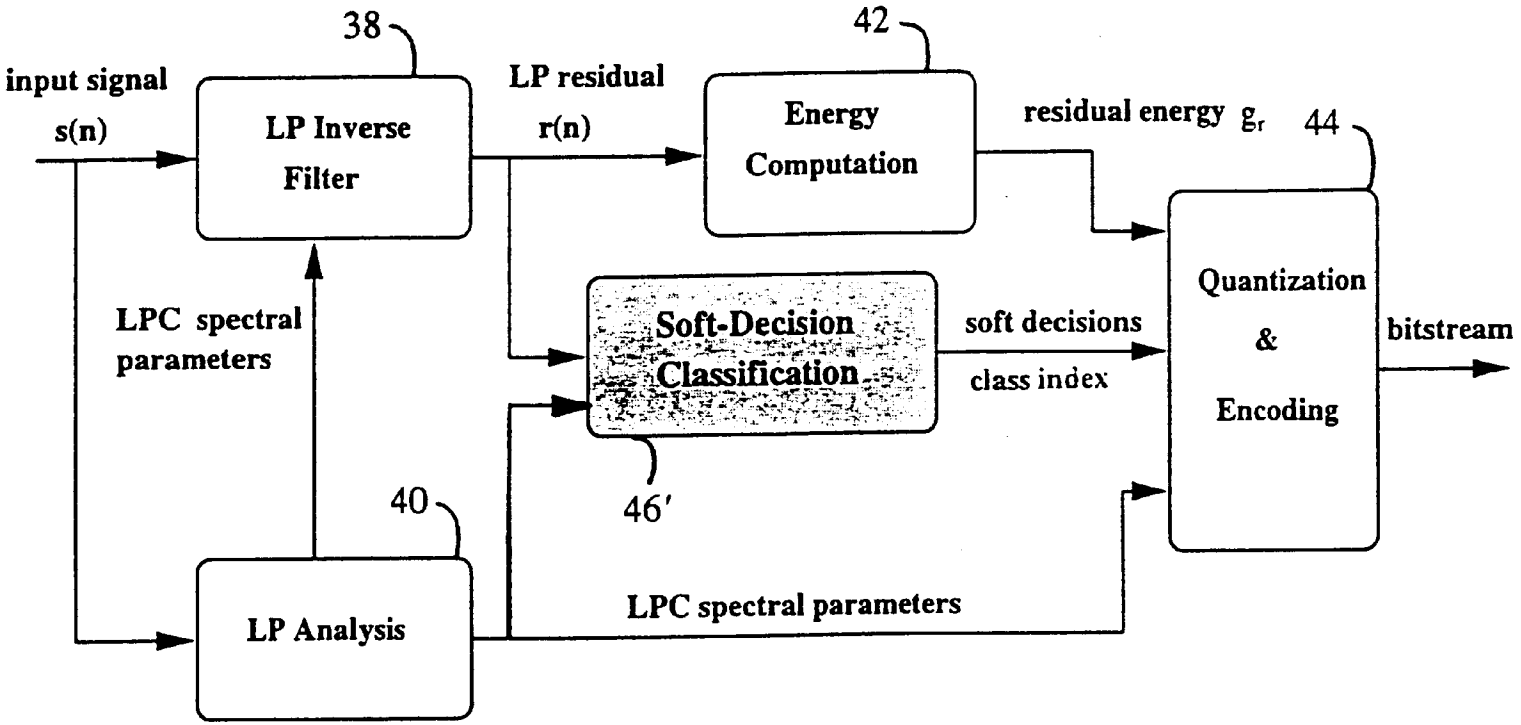
FIG. 7 is a block schematic representation of a second embodiment of the invention, namely an encoder part of a linear prediction-based noise coder which transmits a noise index indicating a plurality of weights for a particular noise type.

As discussed in the article by El-Maleh et al. (supra), it might be desirable to classify a particular background noise as containing components of several noise types. FIG. 7 illustrates an encoding unit which differs from that shown in FIG. 2 in that it uses a noise classifier 46' which can determine that a particular background noise segment contains noise from more than one of the classes, and determine approximate proportions in which the noise vectors at the receiver should be mixed. The mixture excitation signal e(n) is modelled as a linear mixture of M excitation signals from the M noise classes. Mathematically, e(n) is given as:

$$e(n) = \sum_{i=1}^{M} \beta_i e_i(n)$$

where $e_i(n)$ is an excitation signal from the ith noise class, and $\beta_i$ is the ith mixing coefficient, taking a value between 0 and 1.

Rather than transmit the exact proportions, the noise classifier 46' approximates proportions to derive mixing coefficients which quantify the contribution of the noise class. More particularly, the mixing coefficients $\beta_1$ to $\beta_M$ represent proportions in which the noise vectors at the receiver should be mixed to approximate the mix of noise types in the input signal. Conveniently, the noise classifier 46' has a table of different valid combinations of the mixing coefficients $\beta_1$ to $\beta_M$, each combination assigned a distinct noise index. The soft-decision classification module 46' determines the appropriate combination of mixing coefficients, determines the corresponding noise index, and transmits it to the receiver. Using known vector quantization techniques, the vector of weights from the classifier 46' is compared to the allowable combinations of weights and the noise index of the closest allowable combination chosen.

Figure 8:
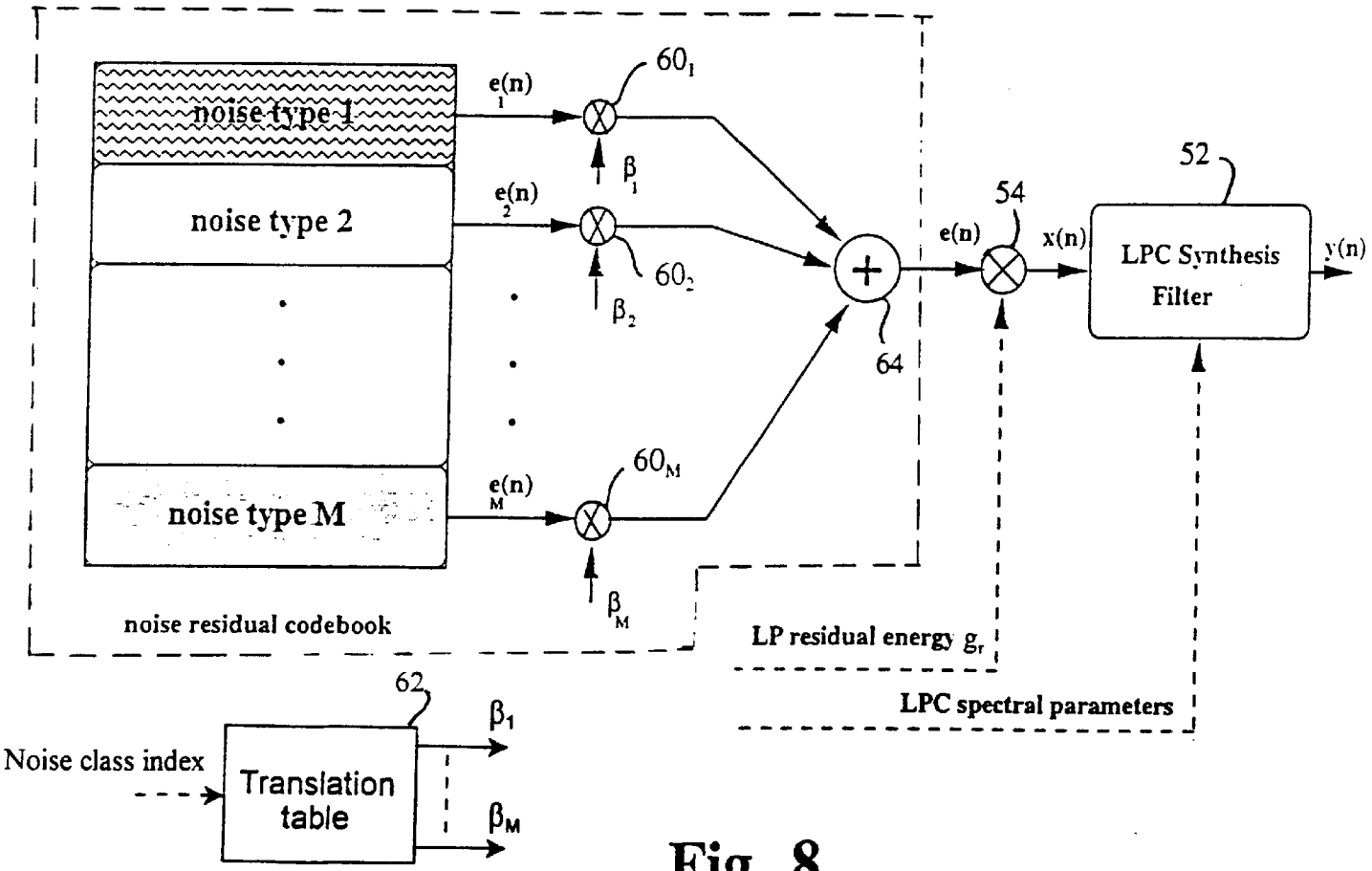
FIG. 8 is a block schematic representation of a part of a decoder corresponding to the encoder of FIG. 7 and which provides an excitation signal from a mixture of excitation vectors.

FIG. 8 illustrates parts of a corresponding decoder which is similar to that shown in FIG. 5. The excitation module in FIG. 8 has a codebook storing the M excitation vectors, as before, but also has a set of multipliers $\mathbf{60}_1$ to $\mathbf{60}_M$ for multiplying the selected vectors by corresponding weighting coefficients $\beta_1$ to $\beta_M$, respectively. In addition, the excitation module 50 has a translation module 62 which receives the noise class index from the decoding and dequantization unit 48 and, using a look-up table similar to that used in the noise classifier 46', or the like, determines the corresponding set of coefficients $\beta_1$ to $\beta_M$ and supplies them to the multipliers $\mathbf{60}_1$ to $\mathbf{60}_M$. The outputs of the multipliers $\mathbf{60}_1$ to $\mathbf{60}_M$ are summed by summing device 64 and the sum is supplied to the multiplier 54 which scales the excitation signal e(n) with the residual energy $g_r$ to give the LPC excitation signal x(n) for filtering by the LPC synthesis filter 52.

An advantage of mixing several vectors in various proportions is that transitions between different synthetic noises are less abrupt and many combinations may be provided using only a limited number of "basic" excitation vectors.

While it is preferable to transmit only one noise index, because that requires minimal bit rate, it would be possible for the noise classifier 46' to transmit several noise indices and their respective proportions. At the receiver, the translation module 62 then could be omitted and the noise indices applied directly to the multipliers $\mathbf{60}_1$ to $\mathbf{60}_M$.

Various other modifications and alternatives to components of the above-described coders are encompassed by the present invention. Thus, it is envisaged that the receiver could perform the noise classification using, for example, hangover frames, rather than the transmitter doing the classification and sending a class index to the receiver. To minimize the occurrence of speech clipping resulting from classification of speech as background noise, a typical voice activity detection (VAD) algorithm includes a hangover mechanism that delays the transition from speech to silence. A hangover period of a few frames (i.e. 3–10) is commonly used. In most cases, the hangover frames contain background noise which is encoded using the full-rate of the speech coder. Using the background noise information contained in the hangover frames, it is possible to do noise classification at the receiver side. This saves the transmitter from transmitting noise classification bits, so the receiver can be used with existing encoders, which may be unchanged.

Figure 9:
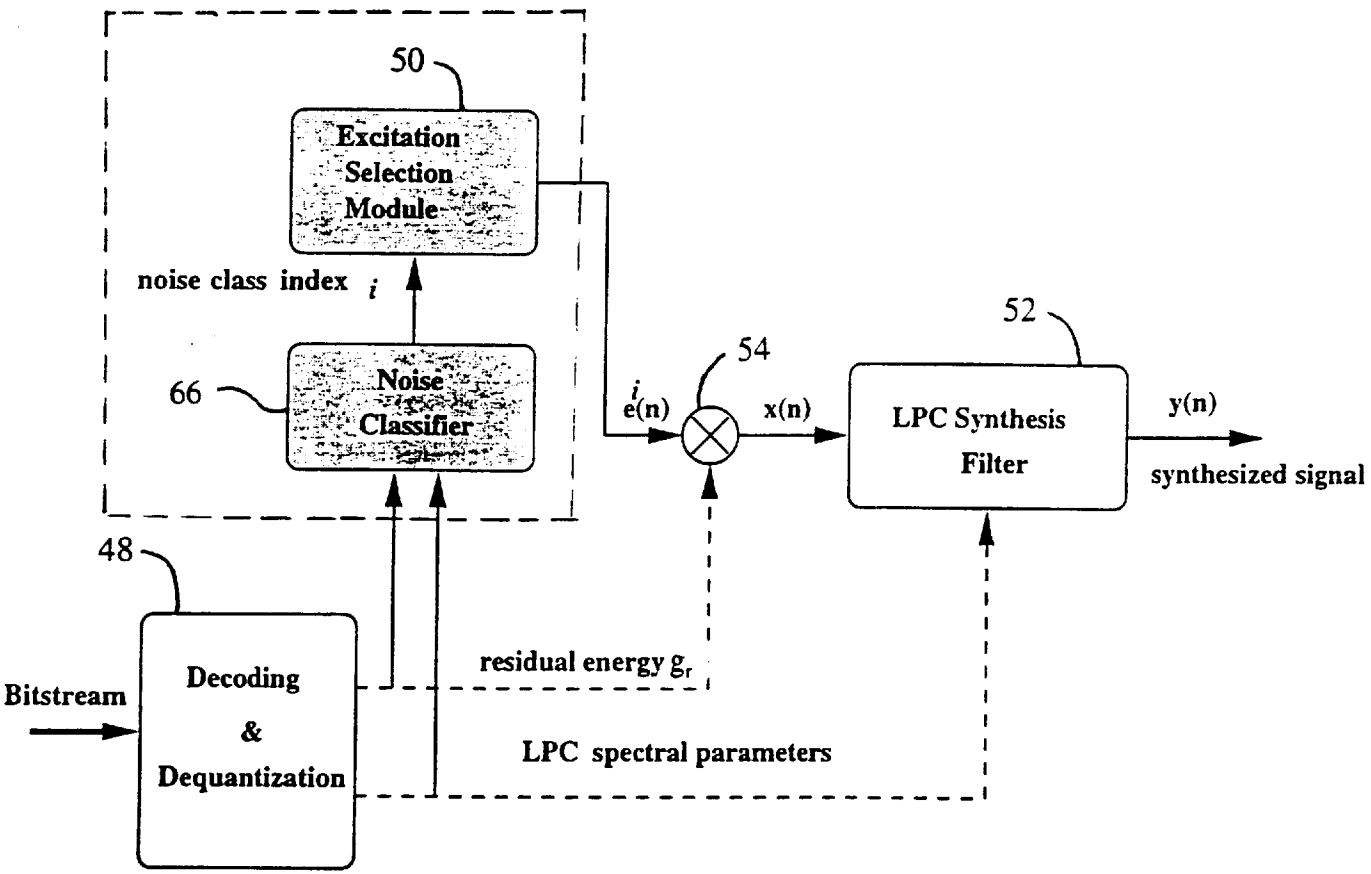
FIG. 9 is a block schematic representation of another embodiment of the invention, namely a decoder part of a linear prediction-based noise coder which includes a noise classifier for deriving the noise class index internally.

Part of such a receiver for performing receive-side noise classification is shown in FIG. 9 and has, in addition to the same components as the decoder part shown in FIG. 3, a noise classifier 66 connected between the decoding and quantization unit 48 and the codebook. The decoding and dequantizing unit 48 detects the hangover frames in known manner and passes them to the noise classifier 66 which classifies the background noise therein using the same kind of analysis as that performed in the noise classifier 46 in FIG. 2. Where variable rate continuous transmission is used, with a low coding rate during speech gaps, the features in the received signal are detected. If transmission is discontinued during speech gaps, SID frames may provide quantized LSFs and quantized energy using full-rate coding. In the example shown in FIG. 9, the noise classifier 66 receives from the decoding and dequantizing unit 48 the residual energy $g_r$ and the LPC parameters and uses them to determine the noise class index $_i$ using similar principles to those used by the noise classifier 48, but operating with quantized features. The noise classifier 66 supplies the noise class index i to the excitation selection module 50 which uses it, as before, to select the appropriate normalized excitation vector $e^i(n)$ for scaling by the residual energy $g_r$ to form the scaled excitation signal x(n).

Preferably, the noise classifier 66 uses quantized LSFs as input features of the hangover frames.

It should be appreciated that determination of the noise class index at the receiver could also be applied to the "soft-decision" embodiment of FIGS. 7 and 8. Thus, the outputs of the excitation module 50 of FIG. 9 could be supplied to a set of multipliers $\mathbf{60}_1$ to $\mathbf{60}_M$ for scaling by a corresponding set of coefficients $\beta_1$ to $\beta_M$ before summing by an adder 64, and the noise classifier 66 of FIG. 9 then could be replaced by a soft-decision noise classifier 46' similar to that described with reference to FIG. 7 and which would generate the coefficients $\beta_1$ to $\beta_M$.

It is also envisaged that hangover frames could be used to update the contents of the noise residual codebook 56. The M noise excitation codevectors are populated with prototype LP residual waveforms from the M noise classes. To update the contents of the noise residual codebook dynamically at the receive side, the excitation signal of the hangover frames could be used. The hangover frames are encoded with the full-rate of the speech coder, with a good reproduction of the LP residual at the transmit side. After classifying a hangover frame to one of the M noise classes, its excitation signal would be used to update the excitation codevector of the corresponding noise class.

It should be noted that the combination of noise classification and residual substitution in accordance with the present invention is not limited to linear predictive synthesis models. It can be retrofitted into other speech coding systems such as Multi-band Excitation (MBE) and Waveform Interpolation (WI) speech coders. For example, multiband class-dependent excitation substitution can be used during speech gaps.

The codebook could store vectors for the basic classes only, all of the mixing being done by multiplying the basic vectors by the mixing coefficients. Alternatively, the codebook could also store some "premixed" vectors which comprise mixtures of two or more basic vectors, in which case some of the multipliers could be omitted. It is conceivable, of course, for the codebook to store all valid combinations of the noise vectors, in various proportions, in which case the multipliers $\mathbf{60}_1$ to $\mathbf{60}_{1M}$ and the translation module 62 would not be needed and the noise classifier 46' would be modified to store information linking each of the valid combinations to a corresponding noise index.

In any of the above-described embodiments, the codebook of stored vectors could be replaced by a suitable "engine" for generating the required vectors as needed. A suitable "engine" might employ multi-band excitation or waveform interpolation.

INDUSTRIAL APPLICABILITY

Embodiments of the present invention, using preclassification of background noise types and class-dependent reproduction of background noise during voice inactivity, produce synthesized noise that sounds similar to the background noise during voice activity. This improvement in noise synthesis results in a much-enhanced overall noise environment for the listener, and improves the overall perceived quality of a voice communication system.

What is claimed is:

1. In a digital communications system comprising a transmitter and a receiver, the transmitter interrupting or reducing transmission of a voice signal during intervals absent speech and the receiver inserting synthetic noise into the received voice signals during said intervals, a method comprising the steps of assigning acoustic background noise in the voice signal to one or more of a plurality of noise classes, selecting a corresponding one of a plurality of excitation vectors each corresponding to at least one of the classes, using at least part of the selected excitation vector to synthesize the synthetic noise, and outputting the synthetic noise during a said interval.

2. A method according to claim 1, wherein the noise classification step is performed at the transmitter, a noise class index corresponding to the one or more noise classes is transmitted to the receiver, and, at the receiver, the noise class index is detected and used to select the corresponding one or more excitation vectors.

3. A method according to claim 1, wherein the plurality of excitation vectors are stored at the receiver and one or more of the vectors selected in dependence upon the noise class index.

4. A method according to claim 1, wherein at least some of said vectors comprise mixture vectors corresponding to different mixtures of a plurality of said noise classes, and the classification step determines a particular one of said mixtures as corresponding to the background noise and transmits a corresponding noise index identifying the corresponding vector, and, at the receiver, the noise index is used to select the corresponding mixture vector.

5. A method according to claim 1, wherein the noise classification step determines that the background noise corresponds to one of a plurality of mixtures of said excitation vectors, the mixtures comprising different proportions of said vectors, and transmits a noise index representing said one of the mixtures, and, at the receiver, the noise index is used to determine the proportions and the step of synthesizing the synthetic noise mixes the excitation vectors in said proportions.

6. A method according to claim 1, wherein said at least part of the selected excitation vector is generated at the receiver upon receipt of the corresponding noise class index.

7. A method according to claim 1, wherein a series of hangover frames are encoded at the transmitter and transmitted to the receiver and the noise class index is determined in the receiver by analyzing background noise present in received hangover frames.

8. A method according to claim 7, wherein background noise parameters are encoded at the transmitter and transmitted to the receiver in hangover frames at the beginning of said interval and the excitation vectors are updated on the basis of the background noise parameters extracted from the received hangover frames.

9. A method according to claim 1, wherein said at least part of the selected excitation vector is used to excite a synthesis filter to synthesize the synthetic noise.

10. A method according to claim 1, wherein the noise classification step is performed on a frame-by-frame basis using relatively long segments of the input voice signal and using line spectral frequencies (LSF) of the signal.

11. A digital communications system comprising a transmitter and a receiver, the transmitter having means for interrupting or reducing transmission of a voice signal during intervals absent speech and the receiver having means for inserting synthetic noise into the received voice signals during said intervals, there being provided means for assigning acoustic background noise in the voice signal to one or more of a plurality of noise classes, selecting a corresponding one of a plurality of excitation vectors each corresponding to at least one of the classes, using at least part of the selected excitation vector to synthesize the synthetic noise, and inserting the synthetic noise into the received signal during a said interval.

12. A system according to claim 11, wherein the noise classification means is at the transmitter, and transmits to the receiver a noise class index corresponding to the one or more noise classes, and the receiver comprises means for detecting the noise class index and, in dependence thereupon, selecting the corresponding one or more excitation vectors.

13. A system according to claim 11, wherein the receiver comprises storage means storing the plurality of excitation vectors and selector means for selecting one or more of the vectors in dependence upon the noise class index.

14. A system according to claim 11, wherein at least some of said vectors comprise mixture vectors corresponding to different mixtures of a plurality of said noise classes, and the classification means determines a particular one of said mixtures as corresponding to the background noise and transmits a corresponding noise index identifying the corresponding mixture vector, the receiver comprising means responsive to the noise index to select the corresponding mixture vector.

15. A system according to claim 11, wherein the noise classification means comprises means for determining that the background noise corresponds to one of a plurality of mixtures of said excitation vectors, the mixtures comprising different proportions of said excitation vectors, and transmitting a noise index representing said one of the mixtures, and the receiver comprises means responsive to the noise index for determining the proportions, the means for generating the synthetic noise mixing the excitation vectors in said proportions.

16. A system according to claim 11, wherein the receiver comprises means for generating said at least part of the selected excitation vector upon receipt of the corresponding noise class index.

17. A system according to claim 11, wherein the transmitter comprises means for transmitting a series of hangover frames to the receiver at the beginning of a said interval and the receiver comprises means for analyzing background noise present in the received hangover frames to determine the noise class index and supplying the noise class index to the means for selecting said one or more excitation vectors.

18. A system according to claim 17, wherein the transmitter comprises means for encoding background noise parameters and transmitting the encoded parameters to the receiver in hangover frames at the beginning of said interval and the receiver comprises means for extracting the background noise parameters from the received hangover frames and updating the excitation vectors on the basis thereof.

19. A system according to claim 11, wherein the receiver comprises a synthesis filter for excitation by said at least part of the selected excitation vector to generate the synthetic noise.

20. A system according to claim 11, wherein the transmitter performs noise classification on a frame-by-frame basis using relatively long segments of the input voice signal using line spectral frequencies (LSF) of the signal.

21. A transmitter for use in the system of claim 11, comprising classification means for classifying acoustic background noise in the voice signal to one or more of a plurality of noise classes, and transmitting to the receiver a noise class index corresponding to the one or more excitation vectors corresponding to the noise classes.

22. A transmitter according to claim 21, wherein the classification means determines the background noise to correspond to one of a plurality of different mixtures of a plurality of said excitation vectors, and transmits a corresponding noise index identifying the corresponding excitation vector mixture to the receiver.

23. A transmitter according to claim 21, wherein the noise classification means comprises means for determining that the background noise corresponds to one of a plurality of mixtures of said excitation vectors, the mixtures comprising different proportions of said vectors, and transmitting a noise index representing said one of the mixtures to the receiver.

24. A transmitter according to claim 21, further comprising means for transmitting a series of hangover frames to the receiver at the beginning of a said interval.

25. A transmitter according to claim 21, further comprising means for encoding background noise parameters and transmitting the encoded parameters to the receiver in at least some of said hangover frames.

26. A transmitter according to claim 21, wherein the noise classification means operates on a frame-by-frame basis using relatively long segments of the input voice signal and using line spectral frequencies (LSF) of the signal.

27. A receiver for a digital communications system according to claim 11, comprising means for selecting at least one of a plurality of excitation vectors each corresponding to at least one of the classes, using at least part of the selected excitation vector to generate the synthetic noise, and outputting the synthetic noise during a said interval.

28. A receiver according to claim 27, for a system according to claim 12, further comprising means for detecting the noise class index and, in dependence thereupon, selecting the corresponding one or more excitation vectors.

29. A receiver according to claim 27, further comprising storage means for storing the plurality of excitation vectors and selector means for selecting one or more of the vectors in dependence upon a noise class index received from the transmitter.

30. A receiver according to claim 27, for use in a system according to claim 13, wherein at least some of said vectors comprise mixture vectors corresponding to different mixtures of a plurality of said noise classes, and the classification means determines a particular one of said mixtures as corresponding to the background noise and transmits a corresponding noise index identifying the corresponding mixture vector, the receiver comprising means responsive to the noise index to select the corresponding mixture vector.

31. A receiver according to claim 27, for a said system wherein the noise classification means comprises means for determining that the background noise corresponds to one of a plurality of mixtures of said excitation vectors, the mixtures comprising different proportions of said vectors, and transmitting a noise index representing said one of the mixtures, the receiver comprising means responsive to the noise index for determining the proportions and means for mixing the excitation vectors in said proportions before application to the means for generating the synthetic noise.

32. A receiver according to claim 27, further comprising means for generating said at least part of the selected excitation vector upon receipt of the corresponding noise class index.

33. A receiver according to claim 27, for a system wherein the transmitter comprises means for transmitting a series of hangover frames to the receiver at the beginning of a said interval, the receiver comprising means for analyzing background noise present in the received hangover frames to determine the noise class index and supplying the noise class index to the means for selecting said one or more excitation vectors.

34. A receiver according to claim 27, for a system wherein the transmitter comprises means for encoding background noise parameters and transmitting the encoded parameters to the receiver in hangover frames at the beginning of said interval, the receiver comprising means for extracting the background noise parameters from the received hangover frames and updating the excitation vectors on the basis thereof.

35. A receiver according to claim 27, comprising a synthesis filter for excitation by said at least part of the selected excitation vector to generate the synthetic noise.

* * * * *